US006104179A

United States Patent [19]

Yukawa

[11] Patent Number: 6,104,179

[45] Date of Patent: Aug. 15, 2000

[54] LOW-POWER CONSUMPTION NOISE-FREE VOLTAGE REGULATOR

[75] Inventor: Akira Yukawa, Tokyo, Japan

[73] Assignee: NEC Corporation, Tokyo, Japan

[21] Appl. No.: 09/357,896

[22] Filed: Jul. 21, 1999

[30] Foreign Application Priority Data

Jul. 23, 1998 [JP] Japan ..... 10-207468

[51] Int. Cl.[7] ..... G05F 3/16

[52] U.S. Cl. ..... 323/316

[58] Field of Search ..... 323/315, 316, 323/313

[56] References Cited

U.S. PATENT DOCUMENTS

Re. 35,261 6/1996 Nelson ..... 323/257

5,241,227 8/1993 Jung et al. ..... 323/312

*Primary Examiner*—Shawn Riley

*Attorney, Agent, or Firm*—Hutchins, Wheeler & Dittmar

[57] ABSTRACT

A voltage regulator has a phase inverter and a phase compensating condenser between an input differential amplification stage and an output voltage regulating stage, the input differential amplification stage compares a feedback voltage proportional to an output signal with a reference voltage so as to supply a first control signal representative of elimination of a difference between the output voltage and a target voltage level through the phase inverter to the output voltage regulating stage, and the phase compensating condenser transfers high-frequency noise components from the output node of the output voltage regulating stage through the phase inverter to the input node of the output voltage regulating stage, thereby eliminating the high-frequency noise components from the output voltage.

31 Claims, 10 Drawing Sheets

LOW-POWER CONSUMPTION NOISE-FREE VOLTAGE REGULATOR

FIELD OF THE INVENTION

This invention relates to a voltage regulator and, more particularly, to a voltage regulator for regulating an output voltage through a differential amplification,

DESCRIPTION OF THE RELATED ART

A typical example of the voltage regulator is shown in FIG. 1 of the drawings. The prior art voltage regulator is broken down into an input stage 1 and an output stage 2. An output voltage vout1 is supplied to a load 3. The output voltage Vout1 is stepped down through a resistive divider, and the output stage 2 produces a feedback voltage Vout2. The feedback voltage Vout2 returns from the output stage 2 to the input stage 1, and the input stage 1 regulates the output voltage Vout1 to a certain level through comparison between the feedback voltage Vout2 and a reference voltage Vref.

The input stage 1 is a kind of differential amplifier connected between a positive power supply line VDD and a ground line GND, and includes a current mirror circuit la serving as an active load. The current mirror circuit 1*a* is implemented by a parallel combination of p-channel enhancement type field effect transistors Qp1/ Qp2, and the drain node of the p-channel enhancement type field effect transistor Qp1 is connected to the gate electrodes of both p-channel enhancement type field effect transistors Qp1/ Qp2. Thus, the p-channel enhancement type field effect transistors Qp1/ Qp2 concurrently vary the channel resistances depending upon the potential level at the drain node.

The input stage 1 further includes a differential circuit 1*b* implemented by a parallel combination of n-channel enhancement type field effect transistors Qn1/ Qn2, and an n-channel enhancement type field effect transistor Qn3. The drain nodes of the n-channel enhancement type field effect transistors Qn1/ Qn2 are respectively connected to the drain nodes of the p-channel enhancement type field effect transistors Qp1/ Qp2, and the source nodes of the n-channel enhancement type field effect transistors Qn1/ Qn2 are connected through the n-channel enhancement type field effect transistor Qn3 to the ground line GND. A bias voltage Vb is supplied to the gate electrode of the n-channel enhancement type field effect transistor Qn3, and makes the n-channel enhancement type field effect transistor Qn3 serve as a constant current source. The reference voltage Vref is applied to the gate electrode of the n-channel enhancement type field effect transistor Qn2, and the feedback voltage Vout2 is supplied to the gate electrode of the other n-channel enhancement type field effect transistor Qn1. The differential circuit 1*b* compares the feedback voltage Vout2 with the reference voltage Vref. When the feedback voltage Vout2 is equal to the reference voltage Vref, the differential circuit 1*b* keeps a drain voltage Vd at the common drain node N1 constant. However, if the feedback voltage Vout2 fluctuates, the differential circuit 1*b* varies the drain voltage Vd in the opposite direction to the potential variation of the feedback voltage Vout2.

The output stage 2 includes a p-channel enhancement type field effect transistor Qp3, a phase compensating condenser C1 and a series of resistors R1/ R2. The p-channel enhancement type field effect transistor Qp3 is connected between the positive power supply line VDD and an output node N2, and the output voltage Vout1 is supplied from the output node N2 to the load 3. The gate electrode of the p-channel enhancement type field effect transistor Qp3 is connected to the common drain node N1, and the drain voltage Vd is supplied to the gate electrode of the p-channel enhancement type field effect transistor Qp3. The capacitor C1 is connected between the common drain node N1 and the output node N2, and prevents the output voltage from oscillation. The series of resistors R1/ R2 is connected between the output node N2 and the ground line GND, and the feedback voltage Vout2 is taken out from an intermediate node N3 between the resistors R1 and R2. For this reason, the feedback voltage Vout2 is given by the following equation.

$$Vout2=Vout1(r2/(r1+r2))$$

where r1 is the resistance of the resistor R1 and r2 is the resistance of the other resistor R2.

Assuming now that the load 3 makes the output voltage Vout1 rise, the feedback voltage Vout2 is proportionally raised, and is supplied to the gate electrode of the n-channel enhancement type field effect transistor Qn1. The feedback voltage Vout2 causes the n-channel enhancement type field effect transistor Qn1 to decrease the channel resistance. As a result, the potential level at the other common drain node N3 is decreased, and makes the p-channel enhancement type field effect transistors Qp1/ Qp2 increase the amount of drain current. The reference voltage Vref keeps the channel resistance of the other n-channel enhancement type field effect transistor Qn2 constant, and the increased drain current raises the potential level at the common drain node N1. The potential level at the common drain node N1 is propagated to the gate electrode of the p-channel enhancement type field effect transistor Qp3, and causes the p-channel enhancement type field effect transistor Qp3 to increase the channel resistance. As a result, the potential level at the output node N2 is decreased. In this way, the input stage regulates the output voltage Vout1 to the target level.

The current mirror circuit 1*a* is a kind of constant current circuit, and the effective resistance is extremely large. This results in a large gain. Parasitic capacitors are coupled to the field effect transistors and the conductive lines connected therebetween. The parasitic capacitors form a phase shifter, and there is a possibility that the phase shifter makes the phase different at 180 degrees. The feedback from the output stage 2 to the input stage 1 is a kind of negative feedback, and the phase inversion is causative of the oscillation. However, the phase compensating condenser C1 is inserted between the common drain node N1 and the output node N2. The phase compensating condenser C1 is effective against the oscillation.

FIG. 2 illustrates another prior art voltage regulator. The second prior art voltage regulator is also broken down into an input stage 3 and an output stage 4. The input stage 3 and the output stage 4 are connected between a ground line GND and a negative power supply line VSS.

A p-channel enhancement type field effect transistor Qp11, a differential circuit 3*a* and a current mirror circuit 3*b* are connected between the ground line GND and the negative power supply line VSS. The differential circuit 3*a* is implemented by a parallel combination of p-channel enhancement type field effect transistors Qp12/ Qp13, and the current mirror circuit 3*b* is implemented by a parallel combination of n-channel enhancement type field effect transistors Qn11/ Qn12. Thus, the channel conductivity types of the component field effect transistors Qp11/ Qp12/ Qp13 and Qn11/ Qn12 are opposite to those of the component field effect transistors of the first prior art voltage regulator. However, the circuit behavior of the input stage 3 is analogous to that of the input stage 1.

A p-channel enhancement type field effect transistor Qp14 is added to the circuit configuration of the output stage 2.

Although the output voltage Vout1 is controlled by means of an n-channel enhancement type field effect transistor Qn13 instead of the p-channel enhancement type field effect transistor Qp3, the other circuit components arc similar to those of the output stage 2, and are labeled with references used in FIG. 1.

A problem inherent in the first prior art voltage regulator is the transmission of high-frequency noise component of the positive power voltage Vdd from the common drain node N1 to the output node N2, because the phase compensating condenser C1 is equivalent to a short-circuit for the high frequency noise component.

A problem inherent in the second prior art voltage regulator is a large amount of electric power consumed therein. The bias voltage Vb is supplied to the gate electrode of the p-channel enhancement type field effect transistor Qp14, and causes the p-channel enhancement type field effect transistor Qp14 to flow the bias current more than the maximum load current.

SUMMARY OF THE INVENTION

It is therefore an important object of the present invention to provide a voltage regulator, which is free from the problems inherent in the prior art voltage regulators.

In accordance with one aspect of the present invention, there is provided a voltage regulator comprising an input stage having a first input node supplied with a feedback voltage signal and a first output node, and comparing the feedback voltage signal with a reference voltage for producing a first control signal at the first output node, a phase inverting stage including a phase compensating sub-circuit having a second input node and a second output node and a phase inverter having a third output node and a third input node connected to both of the first output node and the second output node, and inverting a voltage variation at the third input node for producing a second control signal opposite in phase to the potential level at the third input node and an output stage having a fourth input node connected to the third output node, a fourth output node connected to a load and a fifth output node connected to the first input node, responsive to the second control signal for regulating an output voltage to a target range, and generating the feedback voltage varied in proportion to the output voltage.

BRIEF DESCRIPTION OF THE DRAWINGS

The features and advantages of the voltage regulator will be more clearly understood from the following description taken in conjunction with the accompanying drawings in which.

DESCRIPTION OF THE PREFERRED EMBODIMENTS

First Embodiment

Figure 3:
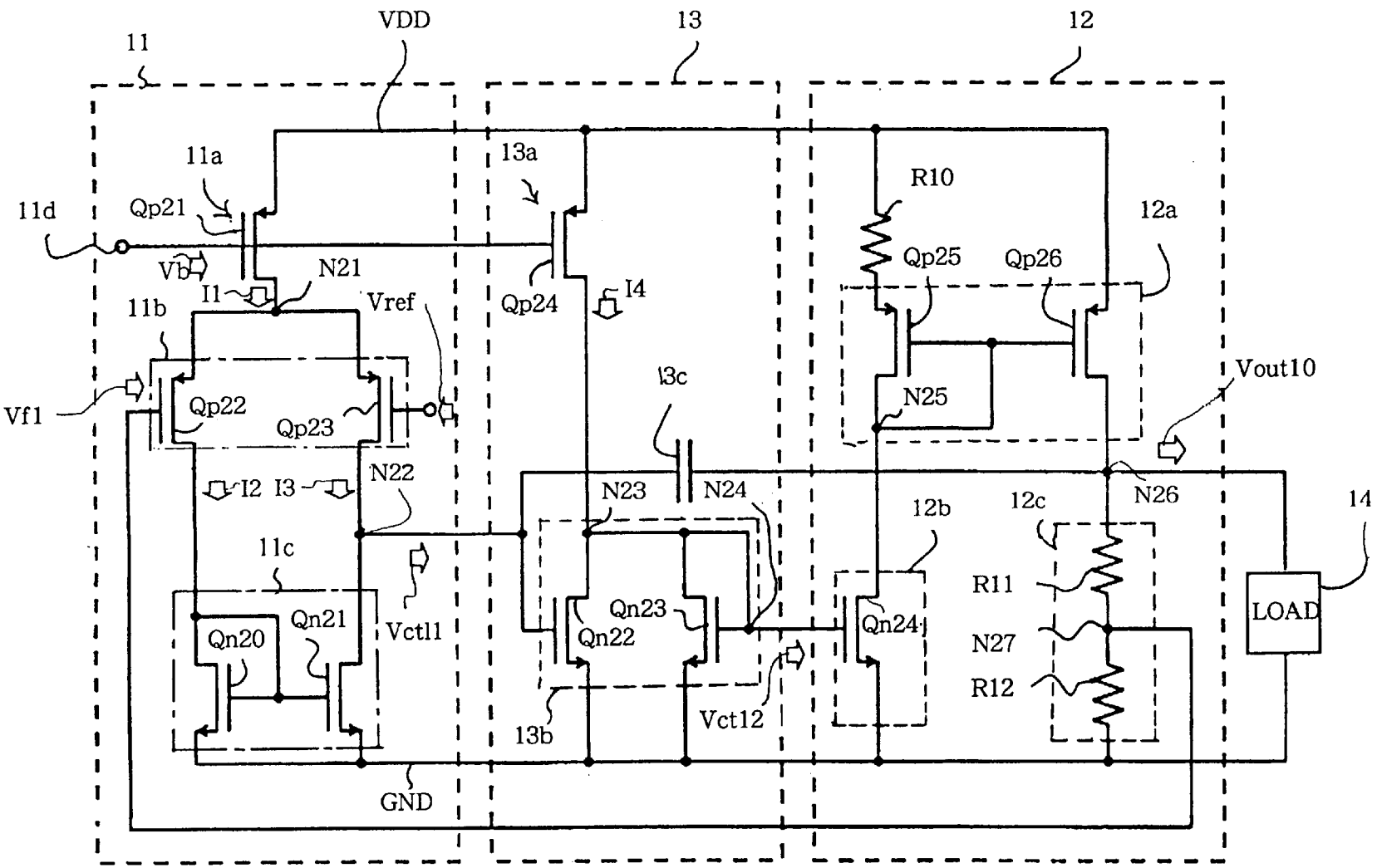
FIG. 3 is a circuit diagram showing the circuit configuration of a voltage regulator according to the present invention.

Referring to FIG. 3 of the drawings, a voltage regulator embodying the present invention largely comprises an input stage 11, an output stage 12 and a phase inverting stage 13. The voltage regulator drives a load 14 with an output voltage Vout10 regulated to a target level.

The input stage 11 compares a feedback voltage signal Vf1 indicative of the magnitude of the output voltage Vout10 with a reference voltage Vref to see whether or not the output voltage Vout10 is equal to the target level. If the output voltage Vout10 is different from the target level, the input stage 11 changes a first control voltage signal Vct11, and instructs the output stage 12 to vary the output voltage Vout10 to the target level through the phase inverting stage 13.

The phase inverting stage 13 produces a second control voltage signal Vct12 from the first control voltage signal Vct11, and controls the output stage 12 with the second control voltage signal Vct12. The phase inverting stage 13 is further operative to eliminate a high-frequency noise component from the output voltage Vout10. The feedback voltage signal Vf1 is lower than the output voltage Vout10, and is varied in proportion to the output voltage Vout10.

The input stage 11 is a kind of differential amplifier, and includes a constant current source 11*a*, a differential circuit 11*b* and a current mirror circuit 11*c*. The constant current source 11*a* is implemented by the combination of a p-channel enhancement type field effect transistor Qp21 and a bias voltage source 11*d*. The bias voltage source 11*d* supplies a bias voltage signal Vb to the gate electrode of the p-channel enhancement type field effect transistor Qp21, and keeps the drain current I1 thereof constant.

The differential circuit 11*b* is implemented by a parallel combination of p-channel enhancement type field effect transistors Qp22/ Qp23. The p-channel enhancement type field effect transistors Qp22/ Qp23 have a common source node N21, and the common source node N1 is connected to the drain node of the p-channel enhancement type field effect transistor Qp21. The feedback voltage signal Vf1 is supplied to the gate electrode of the p-channel enhancement type field effect transistor Qp22, and the reference voltage Vref is supplied to the gate electrode of the p-channel enhancement type field effect transistor Qp23. While the feedback voltage signal Vf1 is equal to the reference voltage Vref, the drain current I1 is evenly split into drain currents 12 and 13. However, if the feedback voltage signal Vf1 is deviated from the reference voltage Vref, the p-channel enhancement type field effect transistors Qp22 and Qp23 oppositely vary the drain currents I1 and I3.

The current mirror circuit 11*c* serves as an active load, and is implemented by a parallel combination of n-channel enhancement type field effect transistors Qn20 and Qn21. The n-channel enhancement type field effect transistors Qn20 and Qn21 have respective drain nodes connected to the drain nodes of the p-channel enhancement type field effect transistors Qp22 and Qp23, respectively, and the common source node of the n-channel enhancement type field effect transistors Qn20/ Qn21 is connected to the ground line GND. The drain node of the n-channel enhancement type field effect transistor Qn20 is connected to the gate electrodes of both n-channel enhancement type field effect transistors Qn20/ Qn21. The common drain node N22 between the p-channel enhancement type field effect transistor Qp23 and the n-channel enhancement type field effect transistor Qn21 serves as an output node N22, and the first control voltage signal Vct11 is produced at the common drain node N22.

While the feedback voltage signal Vf1 is equal to the reference voltage Vref, the n-channel enhancement type field effect transistors Qn20 and Qn21 offer the channel resistances equal to one another against the drain currents 12 and 13, and equalize the drain currents 12 and 13. As a result, the first control voltage signal Vetl1 is un-changed.

If the feedback voltage signal Vf1 rises over the reference voltage Vref, the p-channel enhancement type field effect transistor Qp22 increases the channel resistance. However, the other p-channel enhancement type field effect transistor Qp23 keeps the channel resistance constant. As a result, the drain current I2 becomes less than the other drain current I3. The drain current I2 makes the gate potential at the gate electrodes of the n-channel enhancement type field effect transistors Qn20 and Qn21 lower, and the n-channel enhancement type field effect transistors Qn20 and Qn21 increases the channel resistances. As a result, the drain current I3 raises the potential level at the output node N22, and the input stage 11 raises the first control voltage signal Vct11.

On the other hand, if the feedback voltage signal Vf1 goes down under the reference voltage Vref, the p-channel enhancement type field effect transistor Qp22 decreases the channel resistance. However, the other p-channel enhancement type field effect transistor Qp23 keeps the channel resistance constant. As a result, the drain current I2 becomes more than the other drain current 13. The drain current I2 makes the gate potential at the gate electrodes of the n-channel enhancement type field effect transistors Qn20 and Qn21 higher, and the n-channel enhancement type field effect transistors Qn20 and Qn21 decreases the channel resistances. As a result, the drain current I3 pulls down the potential level at the output node N22, and the input stage 11 lowers the first control voltage signal Vct11.

The phase inverting stage 13 includes a constant current source 13*a*, a phase inverter or a current mirror circuit 13*b* and a phase-compensating condenser 13*c*. The constant current source 13*a* is implemented by the combination of a p-channel enhancement type field effect transistor Qp24 and the bias voltage source 11*d*. The p-channel enhancement type field effect transistor Qp24 is connected between the positive power voltage line VDD and the phase inverter 13*b*, and the bias voltage source 11*d* supplies the bias voltage Vb to the gate electrode of the p-channel enhancement type field effect transistor Qp24. Constant current I4 flows through the p-channel enhancement type field effect transistor Qp24 into the phase inverter 13*b*.

The phase inverter 13*b* is implemented by the parallel combination of n-channel enhancement type field effect transistors Qn22/ Qn23. The n-channel enhancement type field effect transistors Qn22/ Qn23 arc connected in parallel between the constant current source 13*a* and the ground line GND. The output node N22 is connected to the gate electrode of the n-channel enhancement type field effect transistor Qn22, and the drain node N23 is connected to the drain node of the other n-channel enhancement type field effect transistor Qn23 and the gate electrode thereof. The gate electrode of the n-channel enhancement type field effect transistor Qn23 serves as an output node N24 of the phase inverting stage 13. The output node N22 is further connected to the phase compensating condenser 13*c*, and the phase compensating condenser 13*c* will be hereinbelow detailed in conjunction with the output stage 12.

When the potential level at the output node N22 rises, the n-channel enhancement type field effect transistor Qn22 decreases the channel resistance thereof, and the potential level at the drain node N23 falls, and, accordingly, the potential level at the output node is decayed. On the other hand, if the potential level at the output node N22 goes down, the n-channel enhancement type field effect transistor Qn22 increases the channel resistance, and the potential level at the drain node N23 and, accordingly, the output node N24 goes up. Thus, the first control voltage signal Vct11 and the second control voltage signal Vct12 are varied in the opposite direction, and the phase inverting stage 13 achieves the phase inversion.

The output stage 12 includes a resistor R10, a current mirror circuit 12*a*, a controller 12*b* and a voltage divider 12*c*. The resistor R10 is connected to the positive power supply line VDD. The current mirror circuit 12a is implemented by the parallel combination of p-channel enhancement type field effect transistors Qp25/ Qp26. The p-channel enhancement type field effect transistor Qp25 is connected between the resistor R10 and the controller 12*b*, and the other p-channel enhancement type field effect transistor Qp26 has the source node directly connected to the positive power supply line VDD. The drain node N25 of the p-channel enhancement type field effect transistor Qp25 is connected to the gate electrodes of the p-channel enhancement type field effect transistors Qp25/ Qp26.

The resistor R10 pulls down the potential level at the drain node N25. The drain node N25 is connected to the gate electrode of the p-channel enhancement type field effect transistor Qp26. However, the positive power voltage is directly supplied to the source node of the p-channel enhancement type field effect transistor Qp26. For this reason, the resistor R10 makes the source-to-gate voltage applied to the p-channel enhancement type field effect transistor Qp26 larger than that of the other p-channel enhancement type field effect transistor Qp25. This results in a large amount of drain current flowing through the p-channel enhancement type field effect transistor Qp26 into the output node N26. Moreover, the p-channel enhancement type field effect transistor Qp26 becomes stable against the variation at the output node N26.

The controller 12*b* is implemented by an n-channel enhancement type field effect transistor Qn24. The n-channel enhancement type field effect transistor Qn24 is connected between the drain node N25 and the ground line GND, and the cats electrode thereof is connected to the output node N24 of the phase compensating stage 13. The voltage divider 12*c* is implemented by a series combination of resistors R11/ R12. The drain node of the p-channel enhancement type field effect transistor Qp26 is connected through an output node N26 to the resistor R11, and the resistor R12 is connected to the ground line GND. An intermediate node N27 is provided between the resistors R11 and R12, and the feedback voltage Vf1 is supplied from the intermediate node N27 to the gate electrode of the p-channel enhancement type field effect transistor Qp22. For this reason, the feedback voltage Vf1 is given as $$Vf1=Vout10\times r12/(r11+r12)$$

where r11 is the resistance of the resistor R11 and r12 is the resistance of the other resistor R12.

When the potential level at the output node N24 rises, the n-channel enhancement type field effect transistor Qn24 decreases the channel resistance, and causes the potential level at the drain node N25 to go down. The p-channel enhancement type field effect transistors Qp25/ Qp26 concurrently decrease the channel resistances thereof, and raise the output voltage Vout10. On the other hand, if the potential level at the output node N24 falls, the n-channel enhancement type field effect transistor Qn24 causes the current mirror circuit 12*a* to decrease the output voltage Vout10. As described hereinbefore, the second control voltage signal Vct12 is opposite in phase to the first control voltage signal Vct11, and the output stage 12 varies the output voltage Vout10 in such a manner as to regulate the output voltage Vout10 to the target level.

The load 14 is connected between the output node N26 and the ground line GND. The p-channel enhancement type field effect transistor Qp26 and the load 14 are connected in series between the positive power supply line VDD and the ground line GND. The maximum load current does not flow into the n-channel enhancement type field effect transistor Qn24. The manufacturer can design the n-channel enhancement type field effect transistor Qn24 to be much smaller in transistor size than the p-channel enhancement type field effect transistor Qp26. Thus, the voltage regulator according to the present invention is reduced in electric power consumption.

The output node N26 in turn is connected to the phase compensating condenser 13*c*. The output node N26 is connected through the phase compensating condenser 13*c* to the gate electrode of the n-channel enhancement type field effect transistor Qn22 as well as the load 14. Even though the output voltage Vout10 contains high-frequency noise component, the high-frequency noise component is supplied through the phase inverting condenser 13*c* to the gate electrode of the n-channel enhancement type field effect transistor Qn22. The n-channel enhancement type field effect transistors Qn22/ Qn23 inverts the potential variation between the gate electrode of the n-channel enhancement type field effect transistor Qn22 and the gate electrode of the n-channel enhancement type field effect transistor Qn23. The output stage 12 amplifies the potential level at the output node N24 so as to generate the output voltage Vout10 at the output node N26. Thus, the phase compensating condenser 13*c* cooperates with the controller 12*b* and the current mirror circuit 12*a*, and the phase compensating condenser 13*c*, the controller 12*b* and the current mirror 12*a* eliminate the high-frequency noise component from the output voltage Vout10.

Description is hereinbelow made on the circuit behavior of the voltage regulator according to the present invention. Assuming now that the output voltage Vout10 rises due to the load 14, by way of example, the voltage divider 12*c* raises the feedback voltage Vf1 in proportion to the output voltage Vout10, and the feedback voltage Vf1 is supplied to the gate electrode of the p-channel enhancement type field effect transistor Qn22. The p-channel enhancement type field effect transistor Qn22 increases the channel resistance, and causes the gate voltage of the current mirror circuit 11*c* to go down. Both n-channel enhancement type field effect transistors Qn20/ Qn21 increase the channel resistances. The drain current I3 is increased, and the increased channel resistance of the n-channel enhancement type field effect transistor Qn21 raises the potential level at the output node N22. Thus, the first control voltage signal Vct11 raises the voltage level.

The first control voltage signal Vct11 is supplied to the gate electrode of the n-channel enhancement type field effect transistor Qn22, and the phase compensating condenser 13*c* transfers the high-frequency noise component to the gate electrode of the n-channel enhancement type field effect transistor Qn22. Although the high-frequency noise component rides on the first control voltage signal Vct11, the first control voltage signal Vct11 is described separately from the high-frequency noise component for the sake of simplicity.

When the first control signal Vct11 raises the voltage level, the n-channel enhancement type field effect transistor Qn22 decreases the channel resistance, and causes the potential level at the drain node N23 to go down. The potential level at the output node N24 also goes down. The n-channel enhancement type field effect transistors Qn22/ Qn23 invert the high-frequency noise component, and vary the voltage level of the second voltage control signal Vct12.

As described hereinbefore, the second control voltage signal Vct12 is varied in the opposite direction to the first control voltage signal Vct11. When the second control voltage signal Vct12 falls, the n-channel enhancement type field effect transistor Qn24 increases the channel resistance, and raises the potential level at the drain node N25 and, accordingly, the gate voltages of the p-channel enhancement type field effect transistors Qp25/ Qp26. The p-channel enhancement type field effect transistors Qp25/ Qp26 increase the channel resistances, and the p-channel enhancement type field effect transistor Qp26 urges the output voltage Vout10 to go down. This results in the regulation of the output voltage Vout10 to the target level. The feedback voltage signal Vf1 is pulled down, and the input stage 11 instructs the output stage 12 not to urge the output voltage Vout10 anymore. The controller 12*b* and the current mirror 12*a* eliminates the high-frequency noise component from the output voltage Vout10 by virtue of the inverted highfrequency noise component of the second control voltage signal Vct12.

If the output voltage Vout10 goes down, the input stage 11 instructs the output stage 12 to pull up the output voltage Vout10 through the phase inverting stage 13, and the output voltage Vout10 is regulated to the target level.

As will be understood from the foregoing description, the high-frequency noise component returns through the phase inverter 13*b*, the controller 12*b* and the current mirror circuit 12*a* to the output node N26, and the controller 12*b* and the current mirror circuit 12*a* eliminate the high-frequency noise component from the output voltage Vout10.

The p-channel enhancement type field effect transistor Qp26 is serially connected to the load 14, and the n-channel enhancement type field effect transistor Qn24 is not expected to flow the maximum load current. For this reason, the voltage regulator according to the present invention does not consume the large electric power.

Second Embodiment

Figure 4:
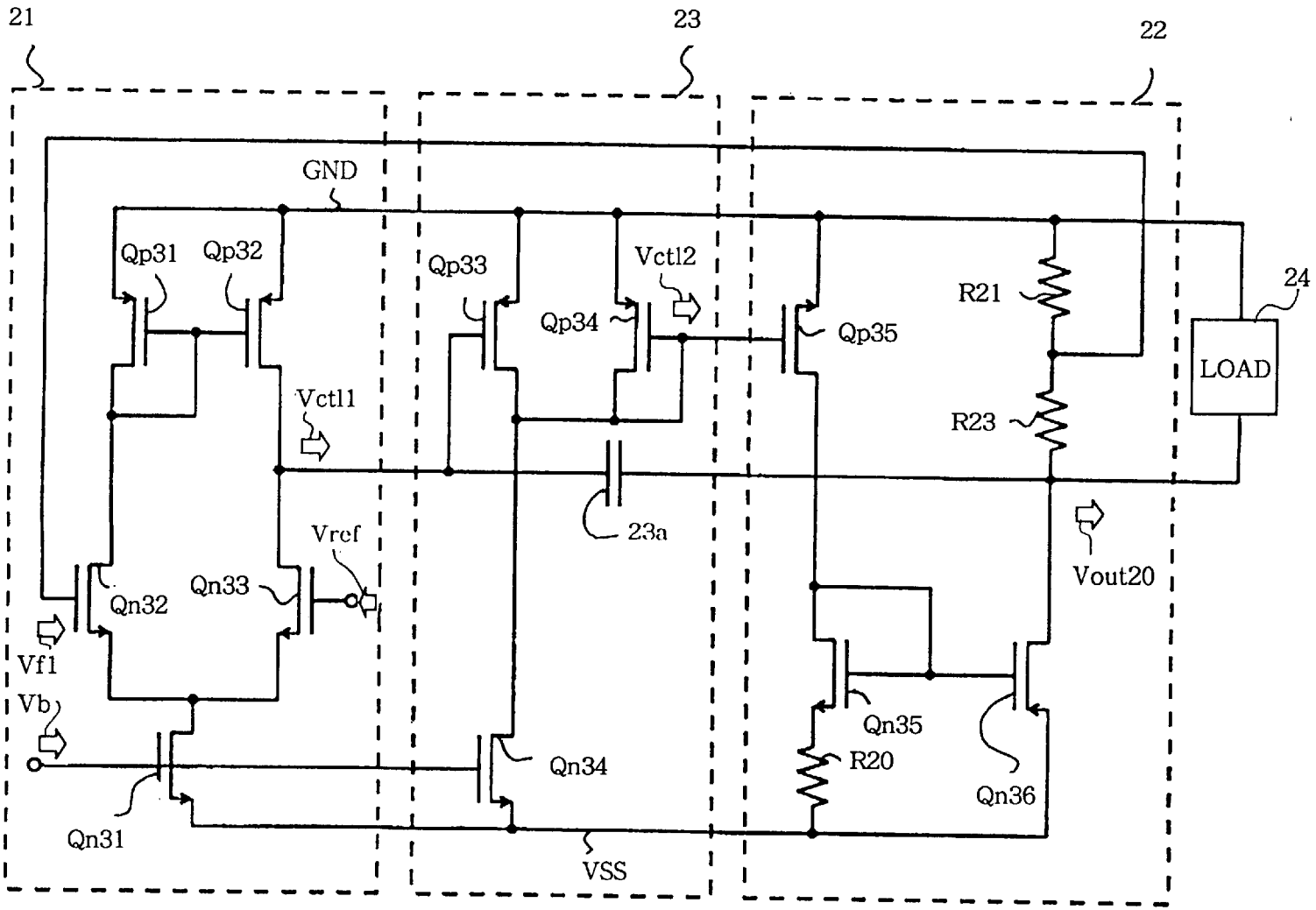
FIG. 4 is a circuit diagram showing the circuit configuration of another voltage regulator according to the present invention.

Turning to FIG. 4 of the drawings, another voltage regulator embodying the present invention largely comprises an input stage 21, an output stage 22 and a phase inverting stage 23. The input stage 21, the output stage 22 and the phase inverting stage 23 are connected between a ground line GND and a negative power supply line VSS, and, accordingly, are powered with the (ground voltage and the negative power voltage.

The input stage 21 is similar in circuit configuration to the input stage 11. However, the component field effect transistors are exchanged between the p-channel type and the n-channel type. For this reason, the component field effect transistors of the input stage 21 are labeled with Qn31, Qn32, Qn33, Qp31 and Qp32, which are corresponding to the field effect transistors Qp21, Qp22, Qp23, Qn20 and Qn21, respectively.

The phase inverting stage 23 is also similar in circuit configuration to the phase inverting stage 13, and the component field effect transistors are exchanged between the p-channel type and the n-channel type. The circuit components of the phase inverting stage 23 are labeled with Qp33, Qp34, 23*a* and Qn34, which are corresponding to the field effect transistors Qn22/ Qn23, the phase compensating condenser 13*c* and the field effect transistor Qp24, respectively.

The output stage 22 is also similar in circuit configuration to the output stage 12, and the component field effect transistors are exchanged between the p-channel type and the n-channel type. The circuit components are labeled with R20, R21, R22, Qp35, Qn35 and Qn36, which are corresponding to R10, R11, R12, Qn24, Qp25 and Qp26, respectively.

Figure 1:
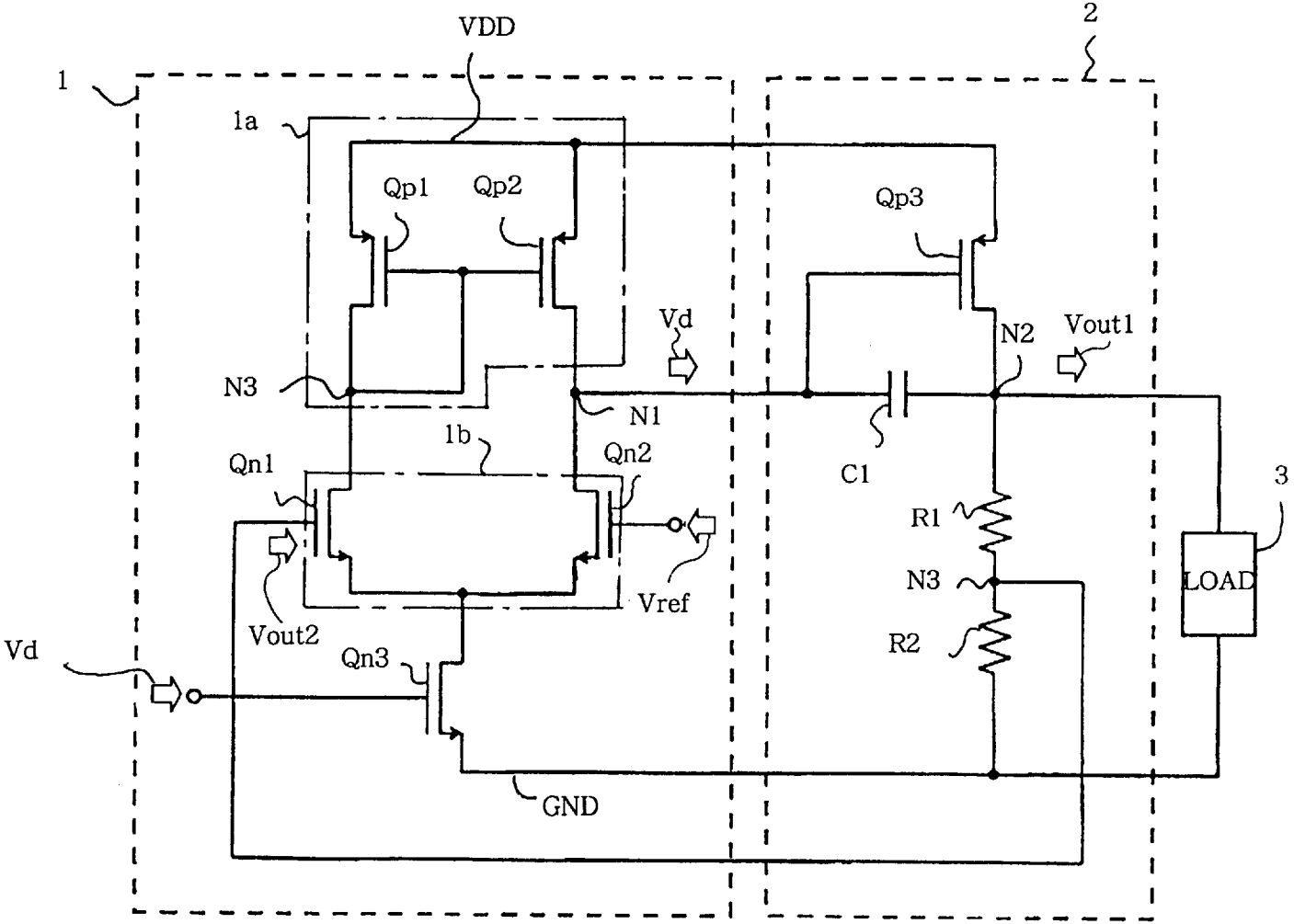
Fig. 1 PRIOR ART
FIG. 1 is a circuit diagram showing the circuit configuration of the first prior art voltage regulator.
Figure 2:
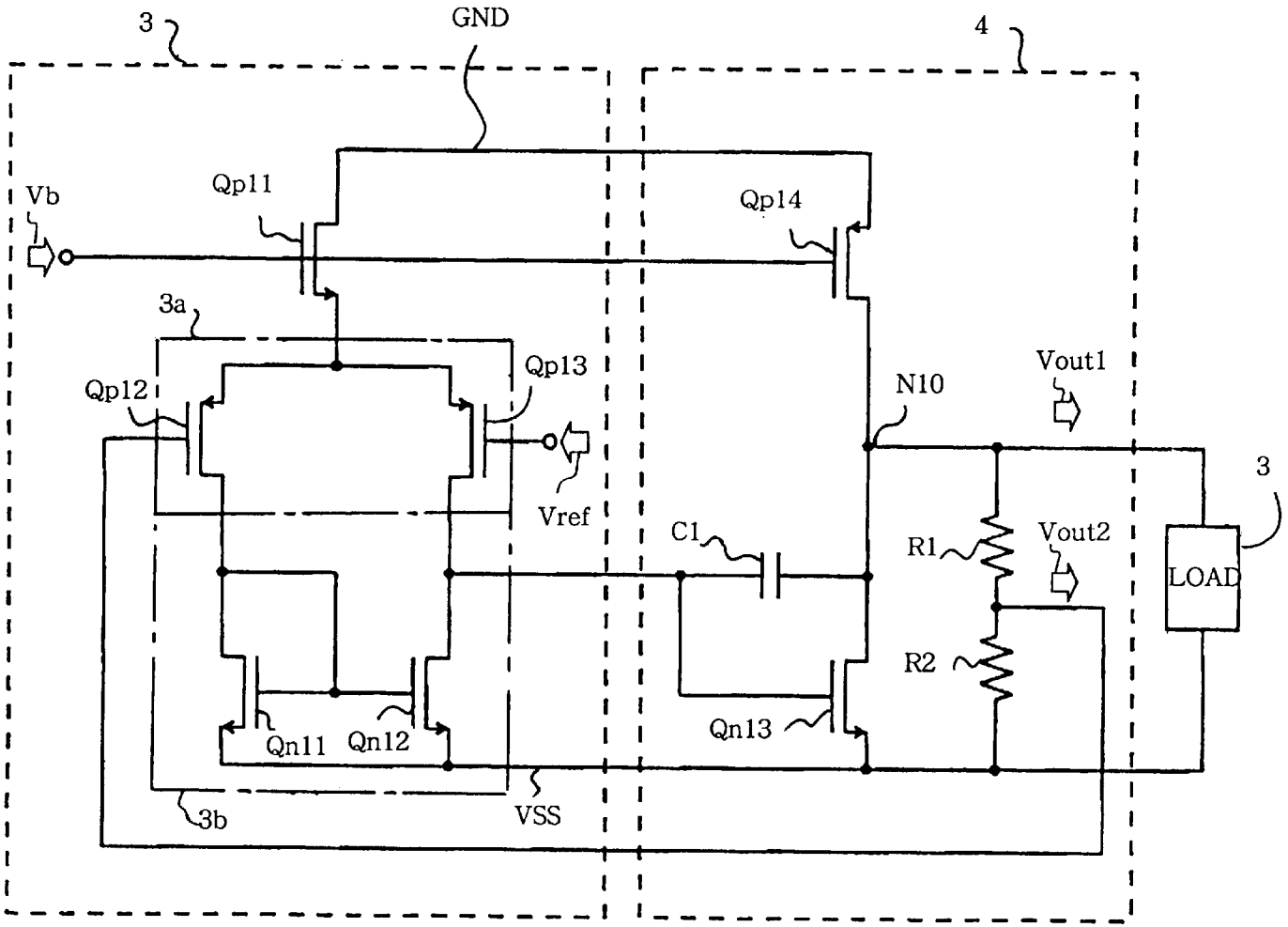
Fig. 2 PRIOR ART
FIG. 2 is a circuit diagram showing the circuit configuration of the second prior art voltage regulator.

Although the power voltages and the channel conductivity type are different from those of the first embodiment, the circuit configuration is analogous to the first embodiment, and the input stage 21, the phase inverting stage 23 and the output stage 22 similarly behaves as those of the first embodiment so as to drive the load 24 with a well-regulated voltage. The phase-compensating condenser 33*a* cooperates with the phase inverter Qp33/ Qp34, and eliminates high-frequency noise components from the output voltage Vout20. The load 24 is serially connected through the n-channel enhancement type field effect transistor Qn36 to the negative power supply line VSS, and the series of the p-channel enhancement type field effect transistor Qp35 and the n-channel enhancement type field effect transistor Qn35 is connected in parallel to the series combination of the load 24 and the n-channel enhancement type field effect transistor Qn36. For this reason, the p-channel enhancement type field effect transistor Qp35 is not expected to flow the maximum load current, and the second embodiment is also smaller in power consumption than the prior art shown in FIG. 2.

Third Embodiment

Figure 5:
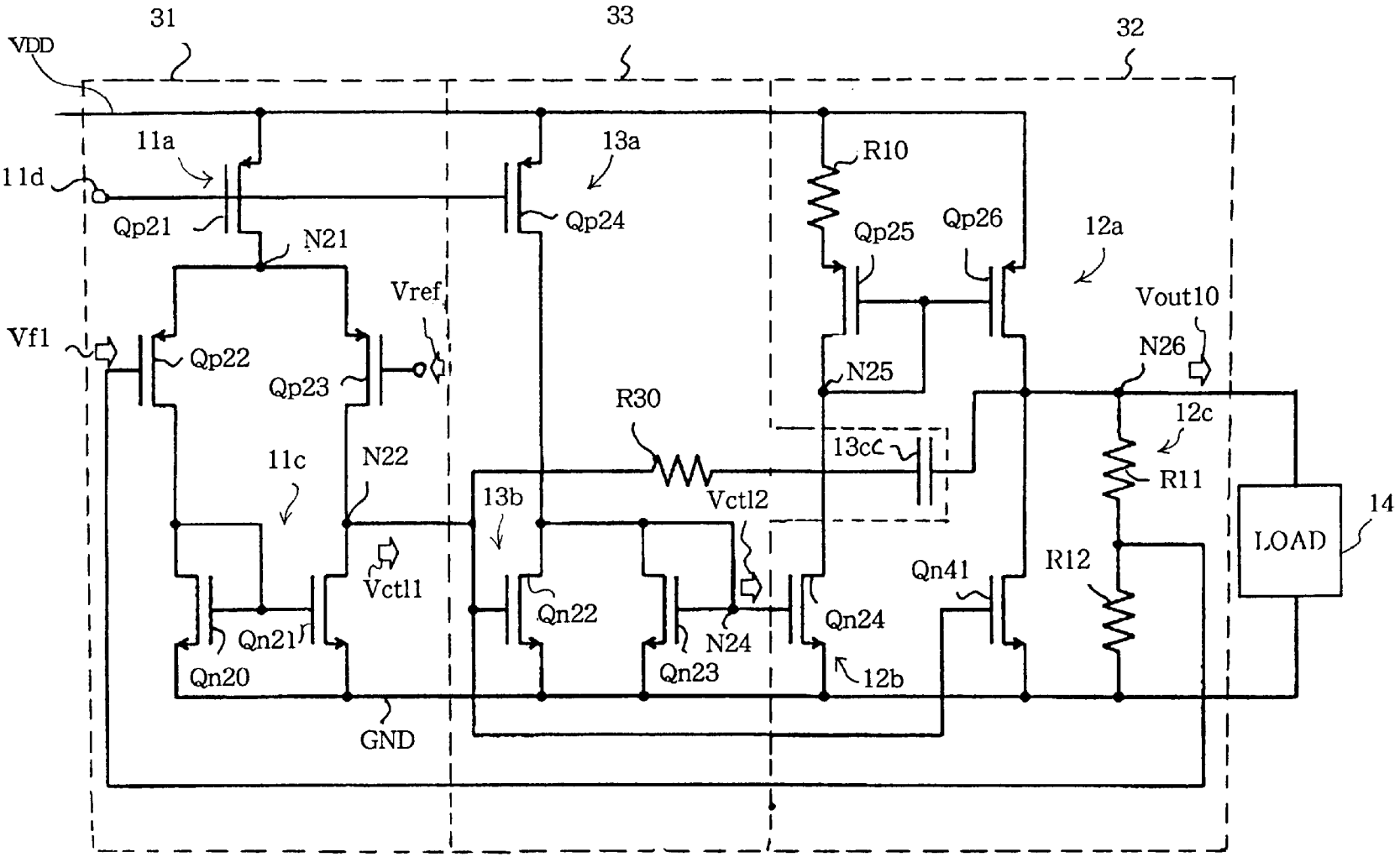
FIG. 5 is a circuit diagram showing the circuit configuration of yet another voltage regulator according to the present invention.

FIG. 5 illustrates yet another voltage regulator embodying the present invention. The voltage regulator implementing the third embodiment also comprises an input stage 31, an output stage 32 and a phase inverting stage 33. The input stage 31 is similar in circuit configuration to the input stage 11, and the phase inverting stage 33 and the output stage 32 are different from the phase inverting stage 13 and the output stage 12 in that a resistor R30 and an n-channel enhancement type field effect transistor Qn41 are newly added. For this reason, circuit components are labeled with the same references designating corresponding circuit components of the first embodiment without detailed description.

The resistor R30 is connected in series to the condenser 13*c*, and allows the manufacturer to adjust the time constant for the phase compensation.

The n-channel enhancement type field effect transistor Qn41 accelerates the voltage regulation. As described hereinbefore, when the output voltage Vout10 rises over the target level, the p-channel enhancement type field effect transistor Qp26 increases the channel resistance, and the output voltage Vout10 is pulled down. In this situation, the first control voltage signal Vct11 is supplied to the gate electrode of the n-channel enhancement type field effect transistor Qn41, and causes the n-channel enhancement type field effect transistor Qp41 to decrease the channel resistance. As a result, the potential fall is accelerated, and the output voltage Vout10 is promptly regulated to the target level.

The voltage regulator implementing the third embodiment achieves all the advantages of the first embodiment.

Fourth Embodiment

Figure 6:
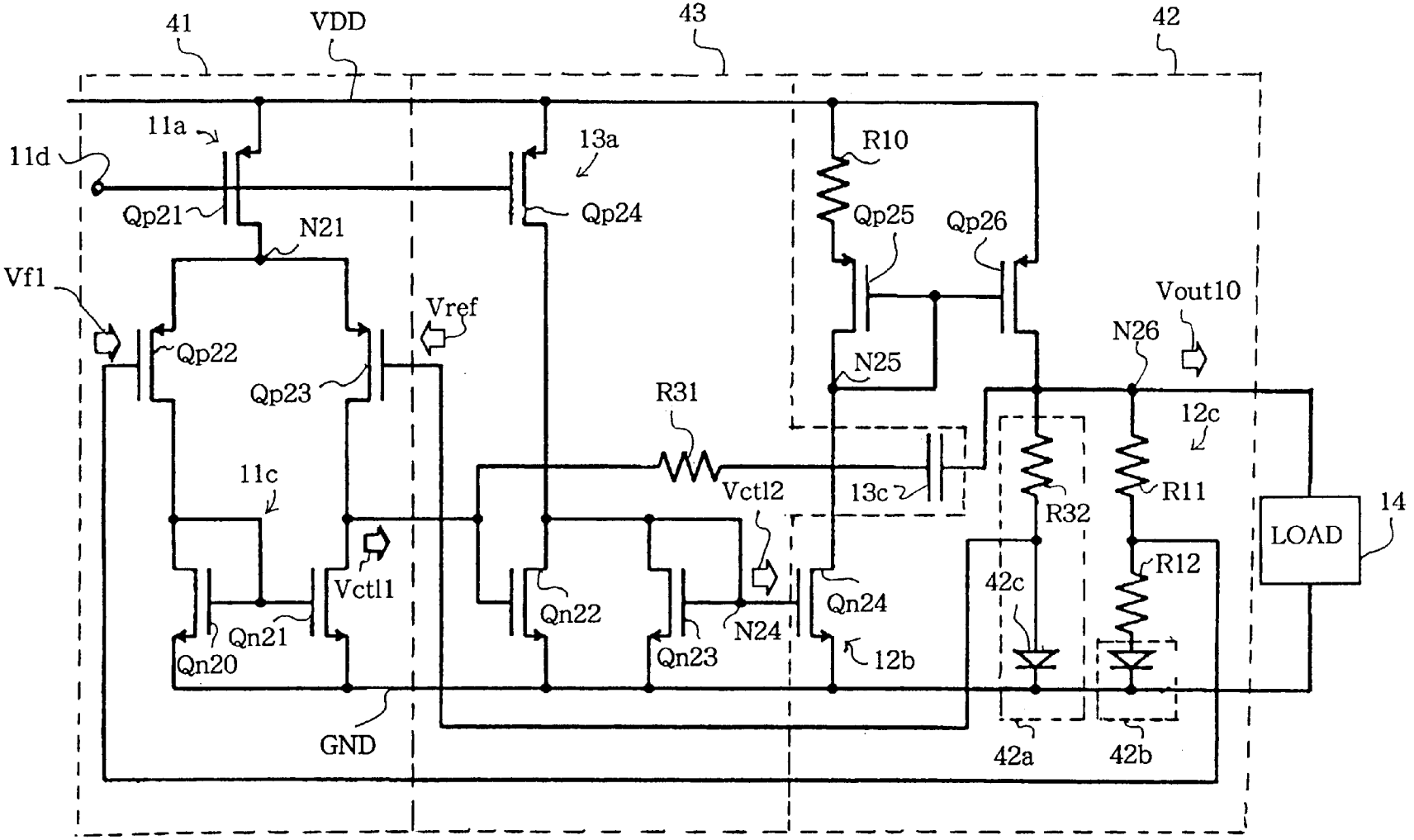
FIG. 6 is a circuit diagram showing the circuit configuration of still another voltage regulator according to the present invention.

FIG. 6 illustrates still another voltage regulator embodying the present invention. The voltage regulator implementing the fourth embodiment comprises an input stage 41, an output stage 42 and a phase inverting stage 43. The input stage 41, the phase inverting stage 43 and the output stage 42 are similar in circuit configuration to those of the first embodiment except a resistor R31, a band-gap reference circuit 42*a* and a diode 42*b*. For this reason, the other circuit components are labeled with the same references designating corresponding circuit components of the first embodiment without detailed description.

The resistor R31 is used for the regulation of the time constant. The band-gap reference circuit 42*a* is implemented by a series combination of a resistor R32 and a diode 42*c*, and the reference voltage Vref is taken out from the anode of the diode 42*c*. The diode 42*c* has the constant forward bias voltage, and the reference voltage Vref is higher than the ground level by the forward bias voltage of the diode 42*c*. The forward bias voltage of the diode 42*c* is stable, and the band-gap reference circuit 42*a* keeps the reference voltage Vref constant. Thus, the reference voltage Vref is internally generated. The diode 42*b* gives the forward bias voltage to the feedback voltage Vf1.

The voltage regulator implementing the fourth embodiment achieves all the advantages of the first embodiment.

Fifth Embodiment

Figure 7:
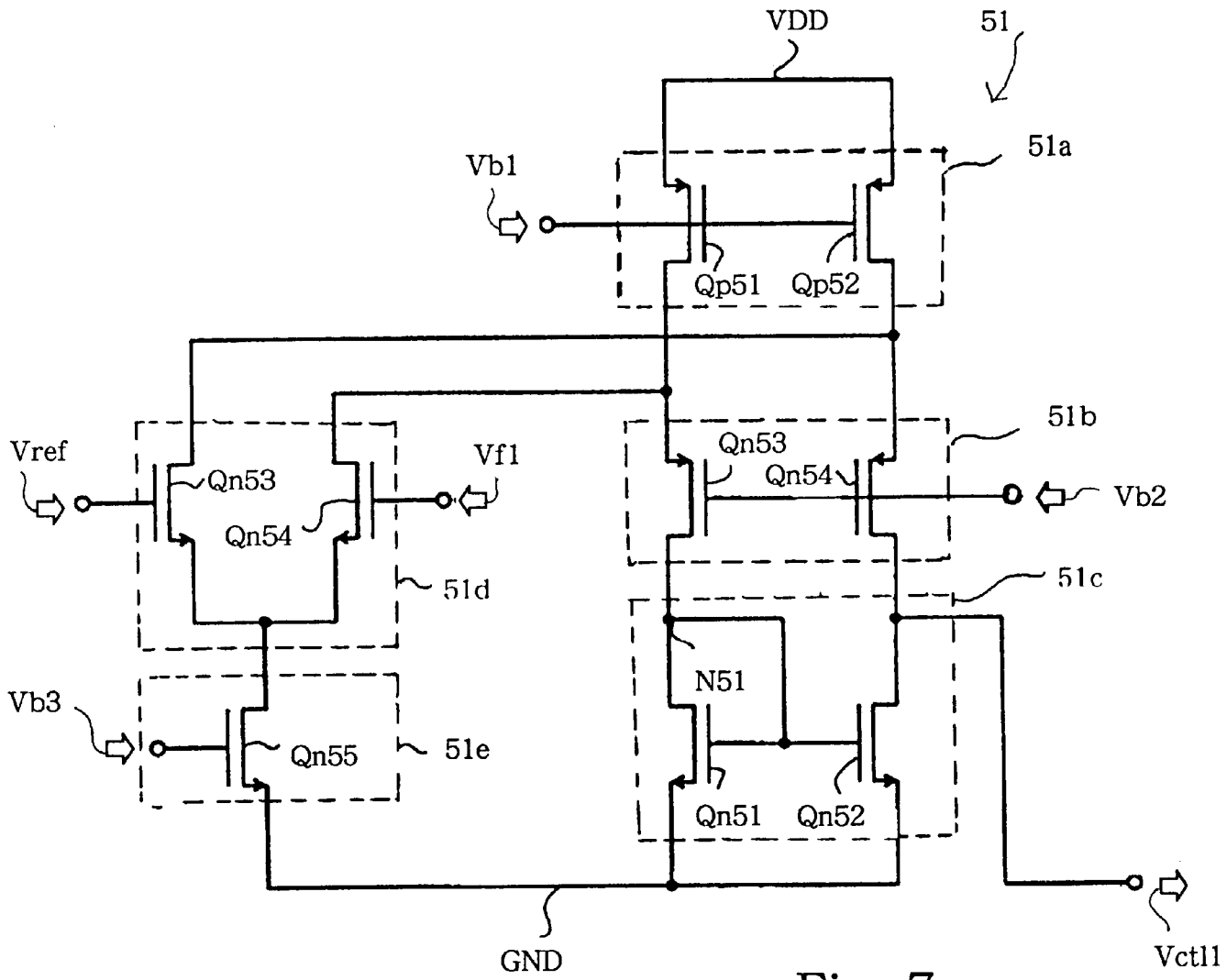
FIG. 7 is a circuit diagram showing the circuit configuration of an input stage incorporated in yet another voltage regulator according to the present invention.

FIG. 7 illustrates an input stage 51 incorporated in yet another voltage regulator embodying the present invention. The input stage 51 has a folded cascade configuration. The input stage 51 includes a first sub-stage 51*a*, a second sub-stage 51*b* and a current mirror circuit 51*c* connected between the positive power voltage line VDD and the ground line GND. The first sub-stage 51*a* is implemented by a parallel combination of p-channel enhancement type field effect transistors Qp51/ Qp52, and a first bias voltage Vb1 is supplied to the gate electrodes of the p-channel enhancement type field effect transistors Qp51/ Qp52. The second sub-stage 51*b* is implemented by a parallel combination of p-channel enhancement type field effect transistors Qp53/ Qp54, and a second bias voltage Vb2 is supplied to the gate electrodes of the p-channel enhancement type field effect transistors Qp53/ Qp54. The current mirror 51*c* is implemented by a parallel combination of n-channel enhancement type field effect transistors Qn51/ Qn52, and the drain node NS1 of the n-channel enhancement type field effect transistor Qn51 is connected to the gate electrodes of the n-channel enhancement type field effect transistors Qn51/ Qn52.

The input stage 51 further includes a differential circuit 51*d* and a constant current source 51*e*. The series combination of the differential circuit 51*d* and the constant current source 51*e* is connected in parallel to the series combination of the second sub-stage 51*b* and the current mirror circuit 51*c*. The differential circuit 51*d* is implemented by a parallel combination of n-channel enhancement type field effect transistors Qn53 and Qn54, and the reference voltage Vref and the feedback voltage Vf1 are supplied to the gate electrode of the n-channel enhancement type field effect transistor Qn53 and the gate electrode of the n-channel enhancement type field effect transistor Qn54, respectively. The constant current source 51*e* is implemented by an n-channel enhancement type field effect transistor Qn55, and a third bias voltage Vb3 is supplied to the gate electrode of the n-channel enhancement type field effect transistor Qn55.

If the reference voltage Vref is close to the positive power voltage, the differential circuit 11*b* tends to malfunction. The differential stage 51*d* is less liable to malfunction under the same conditions.

Sixth Embodiment

Figure 8:
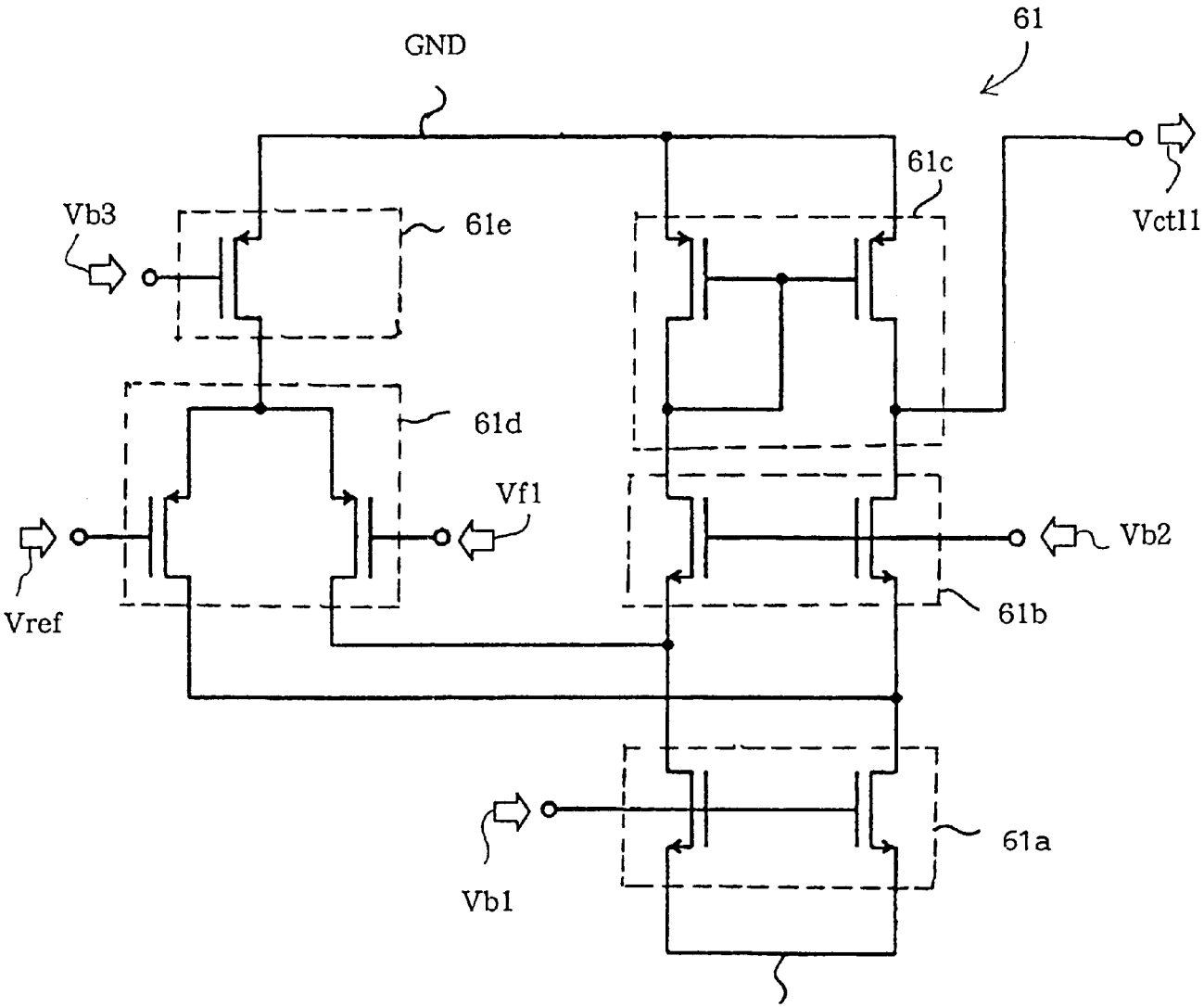
FIG. 8 is a circuit diagram showing the circuit configuration of an input stage incorporated in still another voltage regulator according to the present invention.

FIG. 8 illustrates an input stage 61 incorporated in still another voltage regulator embodying the present invention. The input stage 21 is replaceable with the input stage 61. A first sub-stage 61*a*, a second sub-stage 61*b*, a current mirror circuit 61*c*, a differential circuit 61*d* and a constant current source 61*e* are corresponding to the first sub-stage 51*a*, the second sub-stage 51*b*, the current mirror circuit 51*c*, the differential circuit 51*d* and the constant current source 51*e*, respectively. A first bias voltage Vb1, a second bias voltage Vb2 and a third bias voltage Vb3 are supplied to the first sub-stage 61*a*, the second sub-stage 61*b* and the constant current source 61*e*, respectively. The input stage 61 is stable under the condition where the reference voltage Vref is close to the negative power voltage Vss.

Applications

Figure 9:
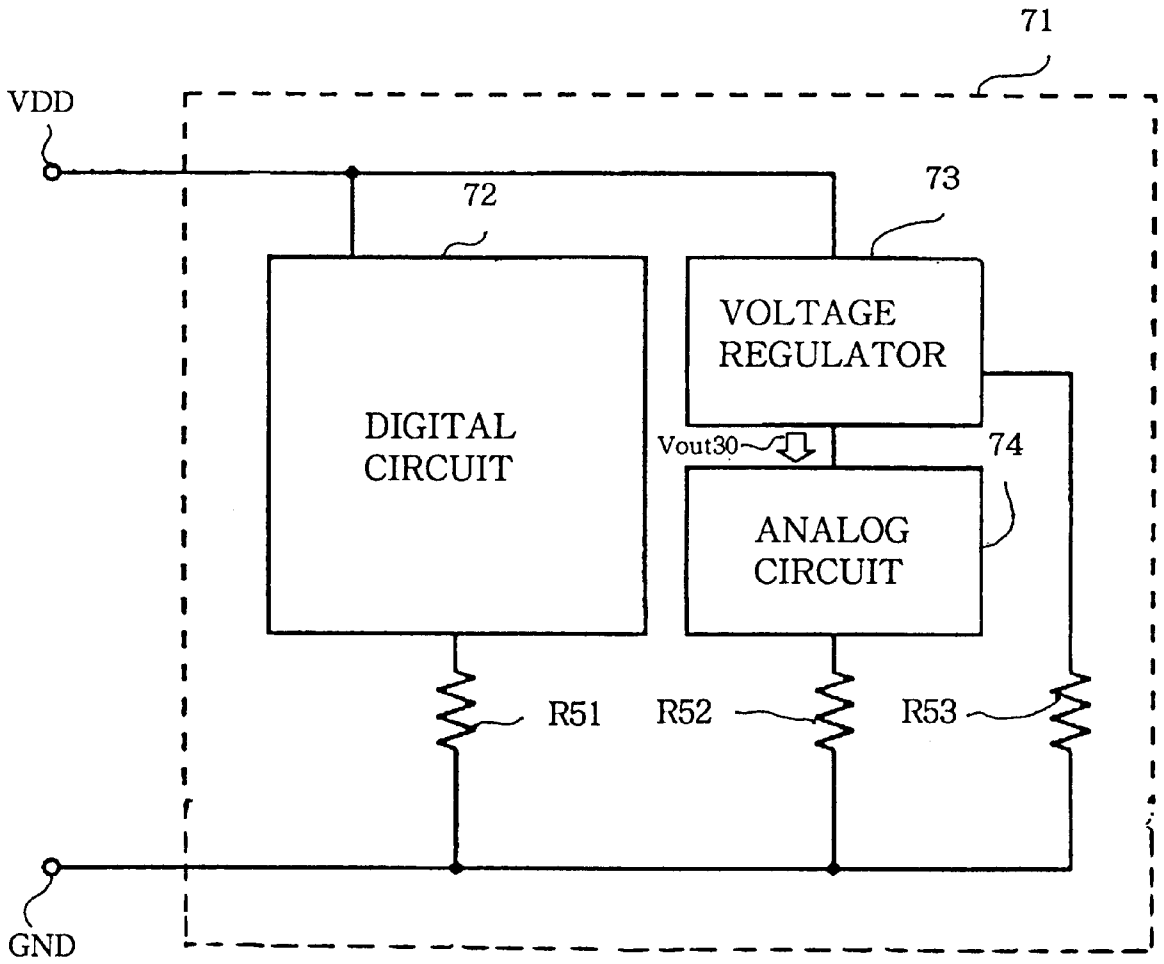
FIG. 9 is a circuit diagram showing an application of the voltage regulator according to the present invention.

FIG. 9 illustrates an integrated circuit 71. The integrated circuit 71 is fabricated on a single semiconductor chip or a printed circuit board. The integrated circuit 71 includes a digital circuit 72, a voltage regulator 73 and an analog circuit 74. The digital circuit 72 is powered from a positive power voltage line VDD and a ground line GND, and a resistor R51 is connected between the digital circuit 72 and the ground line GND.

The voltage regulator 73 has one of the circuit configurations shown in FIGS. 3, 5, 6 and 7. The positive power voltage line VDD is connected to the voltage regulator 73, which in turn is connected through the analog circuit 74 and a resistor R52 and through a resistor R53 to the ground line GND. Thus, the positive power supply line VDD is shared between the digital circuit 72 and the voltage regulator 73, and the voltage regulator 73 supplies well-regulated voltage to the analog circuit 74.

While the integrated circuit 71 is operating, the digital circuit 72 repeats switching actions, and the positive power voltage fluctuates at a high frequency. In other words, a high-frequency noise rides on the positive power voltage. However, the analog circuit 74 is powered through the voltage regulator 73. The voltage regulator 73 eliminates the high-frequency noise from the output voltage Vout30. This results in improved reliability of the analog circuit 74. Moreover, the resistors R51, R52 and R53 are connected between the digital circuit 72, the analog circuit 74 and the voltage regulator 73 and the ground line GND. The resistors R51/ R52/ R53 take up the voltage fluctuation from those circuits 72/ 73/ 74 to the ground line GND.

Figure 10:
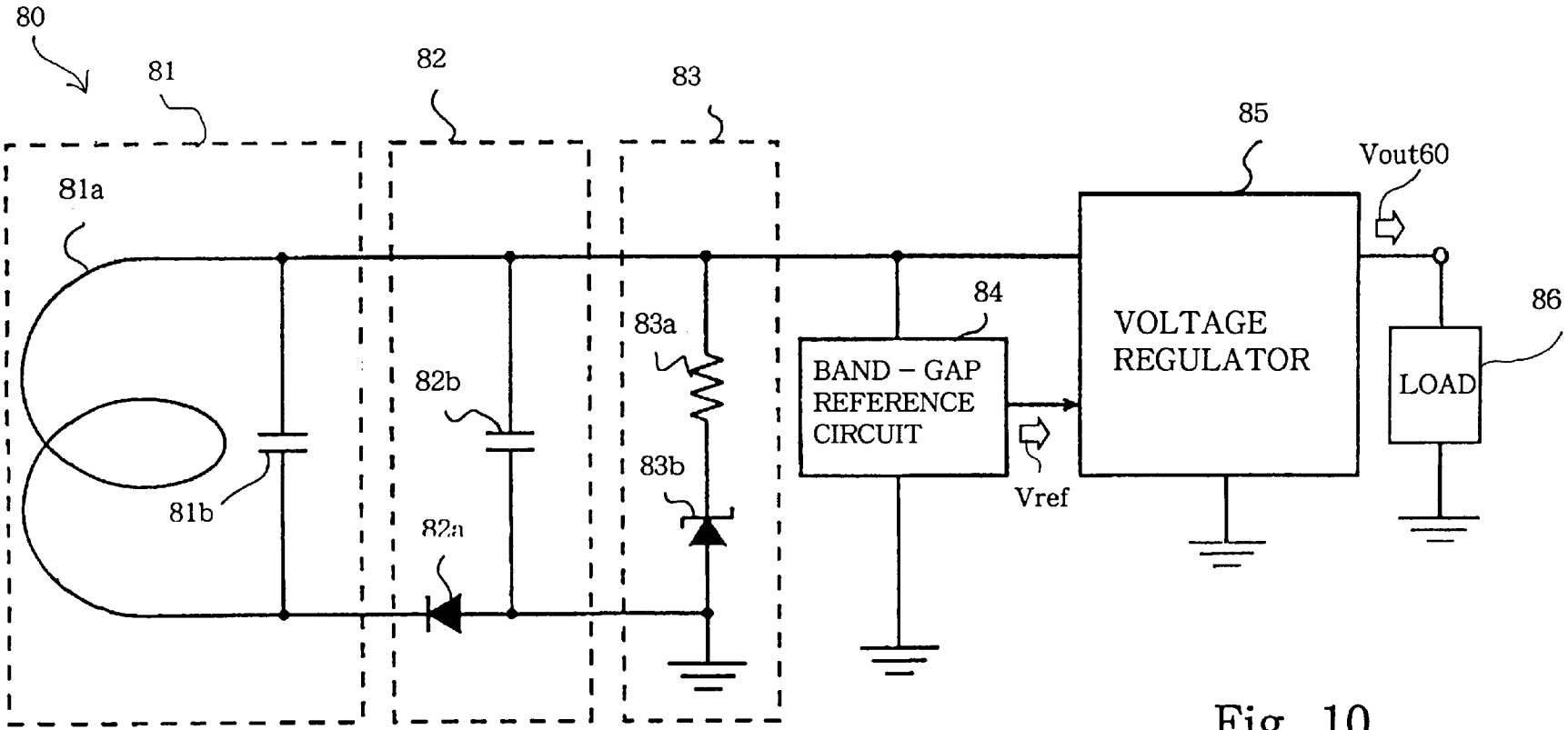
FIG. 10 is a circuit diagram showing another application of the voltage regulator according to the present invention.

FIG. 10 illustrates another application. The application is a non-contact type IC (Integrated Circuit) card 80, and the non-contact type IC card 80 includes a loop antenna circuit 81, a detecting filter 82, a protection circuit 83 against excess voltage, a band-gap reference circuit 84, a voltage regulator 85 and a load 86. The voltage regulator 85 is, by way of example, equivalent to the fourth embodiment.

The loop antenna circuit 81 includes a loop antenna 81a and a condenser 81*b*, and catches electromagnetic wave propagated through the air. The detecting filter 82 includes a diode 82*a* and a condenser 82*b*, and extracts direct current component from the electric power supplied from the loop antenna circuit 81*a*. The protection circuit 83 includes a resistor 83*a* and a Zener diode 83*b*, and prevents the voltage regulator 85 and the band-gap reference circuit 84 from excess voltage.

The voltage regulator 85 eliminates high-frequency noise components from the direct current, and supplies noise-free well-regulated voltage Vout60 to the load 86.

As will be appreciated from the foregoing description, the phase inverter returns the inverted noise component to the output node, and the inverted noise component cancels the high-frequency noise component. As a result, the voltage regulator according to the present invention supplies the noise-free output voltage Vout60 to the load.

Moreover, the load is serially connected through one of the component transistor of the current mirror circuit, and the controller is not expected to flow the maximum load current. For this reason, the power consumption is reduced.

Although particular embodiments of the present invention have been shown and described, it will be apparent to those skilled in the art that various changes and modifications may be made without departing from the spirit and scope of the present invention.

For example, the voltage regulator implementing the second embodiment may include an accelerating transistor corresponding to the n-channel enhancement type field effect transistor Qn41. The resistor R30 may further incorporated in the voltage regulator.

The output stage 22 may have the band-gap reference circuit. In this instance, the ground line GND is connected to the anodes of the diodes 42*b* and 42*c*, and the cathode of the diode 42*b* is connected to the resistor R21.

The input stage 51 is available for the first embodiment, the third embodiment and the fourth embodiment.

What is claimed is:

1. A voltage regulator comprising:

an input stage having a first input node supplied with a feedback voltage signal and a first output node, and comparing said feedback voltage signal with a reference voltage for producing a first control signal at said first output node;

a phase inverting stage including a phase compensating sub-circuit having a second input node and a second output node and a phase inverter having a third output node and a third input node connected to both of said first output node and said second output node, and inverting a voltage variation at said third input node for producing a second control signal opposite in phase to the potential level at said third input node; and an output stage having a fourth input node connected to said third output node, a fourth output node connected to a load and a fifth output node connected to said first input node, responsive to said second control signal for regulating an output voltage to a target range, and generating said feedback voltage varied in proportion to said output voltage.

2. The voltage regulator as set forth in claim 1, in which the input stage includes a constant current source connected between a first source of power voltage and a first node, a current mirror circuit connected at one end thereof to a second source of power voltage different in magnitude from said first source of power voltage and at the other end thereof to a second node and said first output node and responsive to a potential level at said second node for varying the magnitude of said first control signal, and a differential circuit connected between said constant current source and said current mirror circuit and comparing said feedback voltage signal with said reference voltage for varying said potential level at said second node.

3. The voltage regulator as set forth in claim 2, in which the power voltage of said first source and the power voltage of said second source have a positive level and a ground level, respectively.

4. The voltage regulator as set forth in claim 2, in which the power voltage of said first source and the power voltage of said second source have a negative level and a ground level, respectively.

5. The voltage regulator as set forth in claim 1, in which said input stage includes a first sub-stage connected between a first source of power voltage and a first pair of nodes and offering a first constant resistance against electric current, a second sub-stage connected at one end thereof to said first pair of nodes and at the other end thereof to a first node and said first output node and offering a second constant resistance against electric current, a current mirror circuit connected at one end thereof to a second source of power voltage different in magnitude from said first source of power voltage and at the other end thereof to said first node and said first output node and responsive to the potential level at said first node for varying said first control signal, a differential circuit connected between said first pair of nodes and a second node and comparing said feedback voltage signal with said reference voltage for varying said potential level at said first node, and a constant current source connected between said second node and said second source of power voltage and flowing a constant current therethrough.

6. The voltage regulator as set forth in claim 5, in which said first source of power voltage and said second source of power voltage have a positive level and a ground level.

7. The voltage regulator as set forth in claim 5, in which the power voltage of said first source and the power voltage of said second source have a negative level and a ground level.

8. The voltage regulator as set forth in claim 1, in which said phase inverting stage includes a constant current source connected between a first source of power voltage and said third output node and flowing a constant current therethrough, said phase inverter connected between said third output node and a second source of power voltage different in magnitude from said first source of power voltage and introducing a phase difference between said first control signal and said second control signal, and a condenser serving as said phase-compensating sub-circuit and transferring a high-frequency noise from said fourth output node to said third input node.

9. The voltage regulator as set forth in claim 8, in which the power voltage of said first source and the power voltage of said second source have a positive level and a ground level, respectively.

10. The voltage regulator as set forth in claim 9, in which said phase inverter is a parallel combination of field effect transistors connected between said third output node and said second source of power voltage and having respective gate electrodes connected to said third output node.

11. The voltage regulator as set forth in claim 10, in which said field effect transistors are an n-channel enhancement type.

12. The voltage regulator as set forth in claim 8, in which the power voltage of said first source and the power voltage of said second source have a negative level and a ground level, respectively.

13. The voltage regulator as set forth in claim 12, in which said phase inverter is a parallel combination of field effect transistors connected between said third output node and said second source of power voltage and having respective gate electrodes connected to said third output node.

14. The voltage regulator as set forth in claim 13, in which said field effect transistors arc a p-channel enhancement type.

15. The voltage regulator as set forth in claim 8, in which said phase inverting stage further includes a resistor connected between said condenser and said third input node for adjusting a time constant to said high-frequency noise component.

16. The voltage regulator as set forth in claim 1, in which said output stage includes a step-down clement connected between a first source of power voltage and a first node, a current mirror circuit connected at one end thereof to said first node and said first source of power voltage and at the other end thereof to a second node and said third output node and responsive to a potential level at said second node for varying said output voltage, said output voltage being supplied to a load connected between said fourth output node and said second source of power voltage, a controller connected between said second node and said second source of power voltage and responsive to said second control signal for varying said potential level at said second node, and a voltage divider connected between said fourth output node and said second source of power voltage, and producing said feedback voltage signal.

17. The voltage regulator as set forth in claim 16, in which the power voltage of said first source and the power voltage of said second source have a positive level and a ground level.

18. The voltage regulator as set forth in claim 16, in which the power voltage of said first source and the power voltage of said second source have a negative level and a ground level.

19. The voltage regulator as set forth in claim 16, in which said output stage further includes an accelerator connected between said fourth output node and said second source of power voltage and responsive to said first control signal for accelerating a potential variation at said fourth output node.

20. The voltage regulator as set forth in claim 19, in which said accelerator is a first field effect transistor of one channel conductivity type having a gate electrode connected to said first output node, and said controller is a second field effect transistor of the other channel conductivity type opposite to said one channel conductivity type and having a gate electrode connected to said third output node.

21. The voltage regulator as set forth in claim 16, in which said output stage further includes a reference voltage generator for producing said reference voltage, and supplies said reference voltage to said input stage.

22. The voltage regulator as set forth in claim 21, in which said reference voltage generator includes a series combination of a resistor and a first diode connected between said fourth output node and said second source of power voltage and a second diode connected between said voltage divider and said second source of power voltage, and said reference voltage is generated at a node between said resistor and said first diode.

23. The voltage regulator as set forth in claim 1, in which said input stage, said phase inverting stage and said output stage are connected between a first source of power voltage and a second source of power voltage different in magnitude from said first source, and a digital circuit and an analog circuit are connected between said first source of power voltage and said second source of power voltage and between said voltage regulator and said second source of power voltage, respectively.

24. The voltage regulator as set forth in claim 23, in which a first resistor, a second resistor and a third resistor are connected between said digital circuit and said second source of power voltage, between said analog circuit and said second source of power voltage and between said voltage regulator and said second source of power voltage, respectively.

25. The voltage regulator as set forth in claim 1, in which said input stage, said phase inverting stage and said output stage are connected between a first source of power voltage and a second source of power voltage different in magnitude from said first source, and a loop antenna for receiving electromagnetic wave, a detecting filter for extracting a direct current component from an electric power produced from said electromagnetic wave, a protection circuit against an excess voltage, a reference voltage regulator for generating said reference voltage and a load supplied with said output voltage are connected between said first source of power voltage and said second source of power voltage.

26. The voltage regulator as set forth in claim 25, in which said reference voltage (generator is implemented by a series combination of a resistive element and a diode for producing said reference voltage at a node between said resistive element and said diode.

27. A voltage regulator comprising:

an input stage having a first input node supplied with a feedback voltage signal and a first output node, and comparing the feedback voltage signal with a reference voltage for producing a first control signal at said first output node;

a phase inverting stage that produces a second control signal opposite in phase to the first control signal; and an output stage having an input node connected to an output node of the phase inverting stage, an output node connected to a load, responsive to the second control signal for regulating an output voltage to a target range, and generating the feedback voltage in proportion to the output voltage.

28. The voltage regulator of claim 27, wherein the phase inverting stage further includes a phase compensating sub-circuit having an input connected to the input of the phase inverting stage; and an output connected to the load.

29. The voltage regulator of claim 27, wherein the input stage further includes a first sub-stage connected between a first source of power voltage and a first pair of nodes and offering a first constant resistance against electric current;

a second sub-stage connected at one end thereof to the first pair of nodes, and at the other end to a first node of the first output node and offering a second constant resistance against electric current;

a current mirror circuit connected at one end to a second source of power voltage different in magnitude from the first source of power voltage, and at the other end to the first node and the first output node and responsive to the potential level at the first node for varying the first control signal;

a differential circuit connected between the first pair of nodes and a second node, and comparing the feedback voltage signal with the reference voltage for varying the potential level at the first node; and a constant current source connected between the second node and the second source of power voltage, and flowing a constant current therethrough.

30. The voltage regulator of claim 27, wherein the power voltage of the first source and the power voltage of the second source have a negative level and a ground level.

31. The voltage regulator of claim 27, in which the output stage includes a step-down element connected between a first source of power voltage and a first node;

a controller connected between the second source of power voltage and a second node and responsive to the second control signal to vary the potential level at the second node;

an accelerator connected between the controller and the second source of power voltage, and responsive to the first control signal for accelerating the potential level at the second node, where the accelerator is a first field effect transistor of one channel conductivity type having a gate electrode connected to the first node, and the controller is a second field effect transistor of the other channel conductivity type opposite to the first channel type and having a gate electrode connected to the second node.

* * * * *